US009595218B2

(12) United States Patent
Kamal et al.

(10) Patent No.: US 9,595,218 B2
(45) Date of Patent: Mar. 14, 2017

(54) PARTIAL DYNAMIC FALSE CONTOUR DETECTION METHOD BASED ON LOOK-UP TABLE AND DEVICE THEREOF, AND IMAGE DATA COMPENSATION METHOD USING THE SAME

(71) Applicant: SAMSUNG DISPLAY CO., LTD., Yongin, Gyeonggi-Do (KR)

(72) Inventors: Hassan Kamal, Suwon-si (KR); Hee Chul Hwang, Suwon-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 295 days.

(21) Appl. No.: 14/454,246

(22) Filed: Aug. 7, 2014

(65) Prior Publication Data

US 2015/0049958 A1 Feb. 19, 2015

(30) Foreign Application Priority Data

Aug. 14, 2013 (KR) ..... 10-2013-0096810

(51) Int. Cl.

| | |
|---|---|
| ***G09G 3/20*** | (2006.01) |
| ***G09G 3/36*** | (2006.01) |
| *G09G 3/28* | (2013.01) |
| *G09G 3/32* | (2016.01) |

(52) U.S. Cl.

CPC ..... *G09G 3/2044* (2013.01); *G09G 3/3666* (2013.01); *G09G 3/28* (2013.01); *G09G 3/3208* (2013.01); *G09G 2300/0439* (2013.01); *G09G 2300/0452* (2013.01); *G09G 2320/0228* (2013.01); *G09G 2320/0285* (2013.01)

(58) Field of Classification Search

CPC ..... G09G 3/2044; G09G 3/28; G09G 3/3208; G09G 2320/0285; G09G 3/3666; G09G 2300/0439; G09G 2300/0452; G09G 2320/0228

See application file for complete search history.

(56) References Cited

U.S. PATENT DOCUMENTS 6,008,793 A * 12/1999 Shigeta ..... G09G 3/2051 345/204
6,097,368 A * 8/2000 Zhu ..... G09G 3/2033 345/601
6,100,863 A * 8/2000 Zhu ..... G09G 3/2033 345/589
6,108,122 A * 8/2000 Ulrich ..... G09G 3/3629 345/204

(Continued)

FOREIGN PATENT DOCUMENTS

KR 10-2005-0036606 A 4/2005
KR 10-0922793 B1 10/2009

*Primary Examiner* — Manav Seth
(74) *Attorney, Agent, or Firm* — Lee & Morse, P.C.

(57) ABSTRACT

A method for detecting noise includes determining whether a data value of a candidate pixel in a predetermined region of an image matches a first dynamic false contour (DFC) candidate value, determining whether a data value of at least one pixel adjacent to the candidate pixel matches a second DFC candidate value, and changing the data value of the candidate pixel the prior two determinations. The data value of the candidate pixel may be changed to a value in a lookup table. The first and second DFC candidate values may also be stored in one or more lookup tables.

19 Claims, 5 Drawing Sheets

(56) References Cited

U.S. PATENT DOCUMENTS

| | | | | |
|---|---|---|---|---|
| 6,373,477 | B1 * | 4/2002 | Van Dijk | G09G 3/2022 345/204 |
| 6,476,875 | B2 * | 11/2002 | Correa | G09G 3/2029 345/691 |
| 6,697,085 | B2 * | 2/2004 | Lai | G09G 3/2029 345/690 |
| 6,717,558 | B1 * | 4/2004 | Weitbruch | G09G 3/2029 345/63 |
| 6,756,995 | B2 * | 6/2004 | Thebault | G09G 3/2022 345/596 |
| 6,812,936 | B2 * | 11/2004 | Hoppenbrouwers | G09G 3/2029 345/63 |
| 6,989,845 | B1 * | 1/2006 | Okamoto | G09G 3/2029 345/690 |
| 7,102,599 | B2 * | 9/2006 | Okuzawa | G09G 3/2022 315/169.4 |
| 7,154,516 | B2 * | 12/2006 | Kawahara | G09G 3/20 345/63 |
| 7,176,939 | B2 * | 2/2007 | Weitbruch | G09G 3/2029 345/611 |
| 7,221,347 | B2 * | 5/2007 | Lee | G09G 3/3611 324/605 |
| 7,675,483 | B2 | 3/2010 | Okuzawa | |
| 8,305,301 | B1 * | 11/2012 | Wedding | G09G 3/2055 345/60 |
| 8,451,288 | B2 * | 5/2013 | Kondo | G09G 5/02 345/37 |
| 2005/0225512 | A1 * | 10/2005 | Yamada | G09G 3/2051 345/63 |
| 2012/0075320 | A1 * | 3/2012 | Handschy | G09G 3/3629 345/559 |

* cited by examiner

PARTIAL DYNAMIC FALSE CONTOUR DETECTION METHOD BASED ON LOOK-UP TABLE AND DEVICE THEREOF, AND IMAGE DATA COMPENSATION METHOD USING THE SAME

CROSS-REFERENCE TO RELATED APPLICATION

Korean Patent Application No. 10-2013-0096810, filed on Aug. 14, 2013, in the Korean Intellectual Property Office, and entitled, "Partial Dynamic False Contour Detection Method Based On Look-Up Table and Device Thereof, and Image Data Compensation Method Using The Same," is incorporated by reference herein in its entirety.

BACKGROUND

1. Field

One or more embodiments described herein relate to processing image data.

2. Description of the Related Art

Dynamic false counter (DFC) is an effect which degrades the performance of plasma display panel (PDPs), organic light emitting displays (OLEDs), and other types of flat panel displays.

SUMMARY

In accordance with one embodiment, a method of detecting noise in an image includes (a) setting a region to be searched for dynamic false contour (DFC) noise, the region including a candidate pixel and at least one adjacent pixel; (b) determining whether a data value of the candidate pixel matches a DFC candidate value of a first lookup table for candidate pixels, determining (b) including comparing the data value of the candidate pixel with the DFC candidate value of the lookup table for candidate pixels; and (c) determining whether a data value of the at least one adjacent pixel matches a DFC candidate value of a second lookup table for adjacent pixels, determining (c) including comparing the data value of the adjacent pixel with the DFC candidate value of the lookup table for adjacent pixels.

When the data value of the candidate pixel matches at least one DFC candidate value of the first lookup table for candidate pixels in (b), and the data value of the adjacent pixel matches at least one DFC candidate value of the second lookup table for adjacent pixels in (c), DFC noise may be determined to be present in the candidate pixel. When the data value of the candidate pixel does not match the DFC candidate value of the first lookup table for candidate pixels in (b), (b) may include changing the candidate pixel to a subsequent pixel.

When the data value of the candidate pixel matches at least one DFC candidate value of the first lookup table for candidate pixels in (b), and the data value of the adjacent pixel does not match the DFC candidate value of the second lookup table for adjacent pixels in (c), (b) may include changing the candidate pixel with the subsequent pixel.

In accordance with another embodiment, an image data correction method includes changing the data value of the candidate pixel with a DFC noise-free pixel value when DFC noise is determined to be present in the candidate pixel. Presence of the DFC noise in the candidate pixel may be determined, for example, in accordance with the aforementioned embodiment. Changing the data value of the candidate pixel with the DFC noise-free pixel value may include selecting the data value of the candidate pixel from a third lookup table; changing the selected data value of the candidate pixel with the DFC noise-free data value; and performing dithering to compensate for displacement in the data value of the candidate pixel.

In accordance with another embodiment, a dynamic false contour (DFC) detection apparatus includes n line memories to configured receive and temporarily store image data of n pixel lines, respectively; a memory controller configured to store input pixel data in the corresponding n line memories, and to extract corresponding pixel data from the n line memories in parallel; n first comparators configured to compare the pixel data extracted by the memory controller with DFC candidate values stored in a lookup table for adjacent pixels, and to output a comparison result as an m-bit word; first OR logic to generate accumulated m-bit words by performing a bit-by-bit parallel OR operation on the m-bit words output by the n first comparators; n buffer memories configured to sequentially store the accumulated m-bit words generated by the first OR logic; second OR logic configured to generate an m-bit word by performing a bit-by-bit OR operation on the accumulated m-bit words stored in the buffer memory; a second comparator configured to compare data of a candidate pixel with DFC candidate values stored in a lookup table for candidate pixels, and to output a comparison result as an m-bit word; and a result integration module configured to generate an integrated m-bit word by performing a bit-by-bit multiplication operation on the m-bit word generated by the second OR logic and the m-bit word output by the second comparator.

The result integration module may generate a single bit by performing an OR operation on the respective bits of the integrated m-bit word. When a value of the single bit has a first logical value, DFC noise may be determined to be present in the candidate pixel. When the value of the single bit has a second logical value, the DFC noise may be determined to be absent in the candidate pixel.

When a k×k pixel region is set as a search region (where k denotes a natural number less than n), k line memories among the n line memories may be used to temporarily store the image data.

When the k×k pixel region is set as the search region (where k denotes a natural number less than n), k first comparators among the n first comparators may output the comparison result word of m bits and remaining first comparators may output a word in which all the bits have the second logical value.

In accordance with another embodiment, a method for detecting noise includes (a) determining whether a data value of a candidate pixel in a predetermined region of an image matches a first dynamic false contour (DFC) candidate value; and (b) determining whether a data value of at least one pixel adjacent to the candidate pixel matches a second DFC candidate value; and (c) changing the data value of the candidate pixel based on (a) and (b). Operation (c) may include changing the data value of the candidate pixel when the data value of the candidate pixel matches the first DFC candidate value and the data value of the at least one adjacent pixel matches the second DFC candidate value.

The method may include maintaining the data value of the candidate pixel when the data value of the candidate pixel does not match the first DFC candidate value or the data value of the at least one adjacent pixel does not match the second DFC candidate value. The predetermined region may correspond to less than all pixels of the image.

The first DFC candidate value is included in a first lookup table, and the second DFC candidate value is included in a second lookup table. The second lookup table is different from the first lookup table. Also, operation (c) may include changing the data value of the candidate pixel to a value in a third lookup table. The third lookup table may be different from at least one of the first lookup table or the second lookup table.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
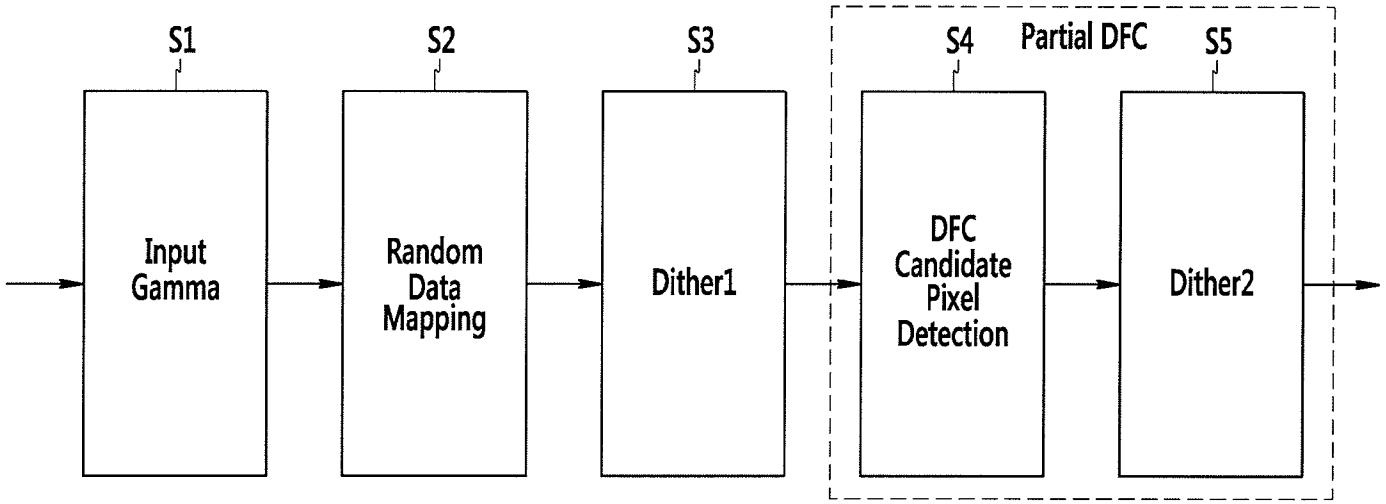
FIG. 1 illustrates an embodiment of an image data correction method.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawing figures, the dimensions of layers and regions may be exaggerated for clarity of illustration. Like reference numerals refer to like elements throughout.

FIG. 1 illustrates an embodiment of an image data correction method. In this embodiment, gamma data for displaying an image is received from an external device (Input Gamma) or source (S1). After the gamma data is received, a width of the data bits of the gamma data may be extended. Random data mapping (RDM) is then performed on the extended bit width data to remove MURA (S2). After performing RDM, the widths of the pixel bits are restored to their original state using, for example, a dithering technique Dither 1 (S3). In one application, Dither 1 may be performed based on a minimum-maximum table that is pre-calculated based on one or more characteristics of the panel and potential dithering noise.

After the dithering technique is performed, a DFC pixel is detected during DFC Candidate Pixel Detection (S4). In one embodiment, two lookup tables for a candidate pixel and an adjacent pixel thereof may be used to perform DFC pixel detection. The lookup tables may be pre-calculated, for example, based on one or more gray scale values for which moving pixel distortion (MPD) is absent. In one example embodiment, the maximum sizes of lookup tables may be fixed. A DFC detection region (pixels positioned around the candidate pixel) may be extended, but may have maximum and minimum limitations. When a DFC pixel is detected, dithering Dither 2 may be performed for removing the DFC pixel (S5).

Figure 2:
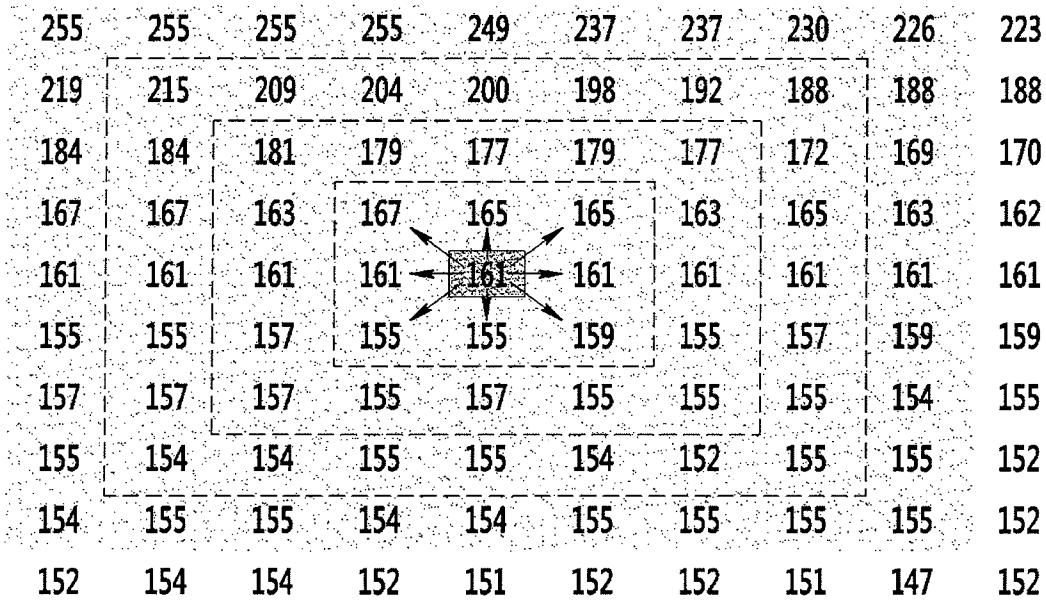
FIG. 2 illustrates pixels subject to DFC pixel detection.
Figure 3:
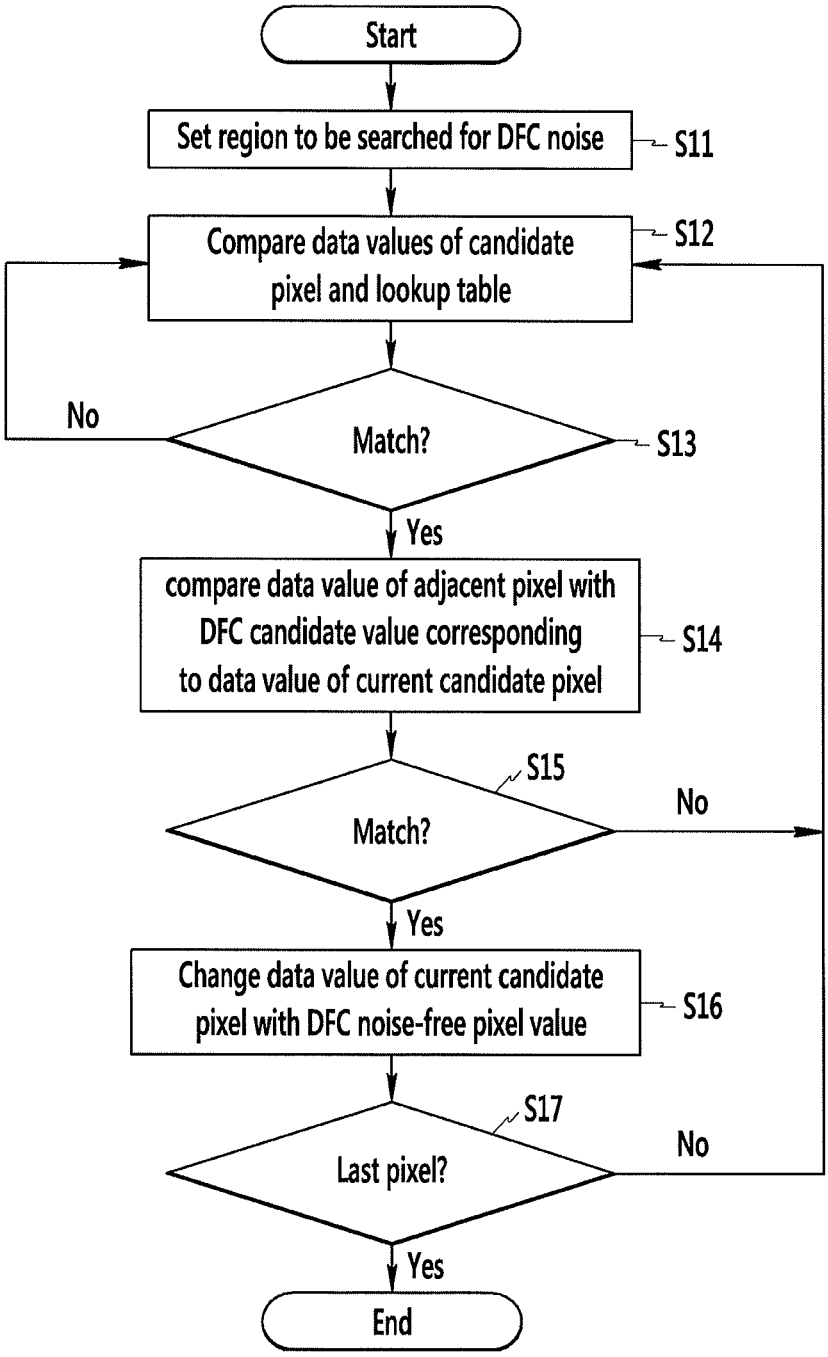
FIG. 3 illustrates an embodiment of a DFC pixel detection method.

FIGS. 2 and 3 show an embodiment of a method for detecting a DFC pixel. More specifically, FIG. 2 illustrates pixel regions in which data comparison may be performed for DFC pixel detection, and FIG. 3 is a flowchart illustrating operations included for performing DFC pixel detection.

Referring to FIG. 3, an initial operation for performing DFC pixel detection includes initially setting a region to be searched for DFC noise (S11). The region to be searched may be set to symmetrically include adjacent pixels based on a candidate pixel, as illustrated in FIG. 2. The region to be searched may be set, for example, as one of a 3×3, 5×5, 7×7, or 9×9 pixel region.

After S11, a data value of the candidate pixel is compared with DFC candidate values of a first lookup table LUT1 for candidate pixels (S12). A determination is then made as to whether the data value of the candidate pixel matches one of the DFC candidate values of the lookup table LUT1 for candidate pixels (S13). When the data value of the candidate pixel matches one of DFC candidate values of the lookup table LUT1 for candidate pixels, operation S14 is performed. Otherwise, a data value of a subsequent candidate pixel (for example, in the set region) is compared with the data values of DFC pixels of the lookup table LUT1 by returning operation S12. The candidate pixels in the set region, therefore, may be compared to the DFC candidate values in lookup table LUT1 on an iterative basis.

When the data value of the candidate pixel matches one of the DFC candidate values of the lookup table LUT1 for candidate pixels, data values of adjacent pixels are compared to the DFC candidate value corresponding to the data value of the candidate pixel, in a second lookup table LUT2 (S14). A determination is then made as to whether the data value of the candidate pixel matches a DFC candidate value of lookup table LUT2 for the adjacent pixels (S15).

When a predetermined number of the data values of the adjacent pixels matches one of the DFC candidate values in the lookup table LUT2 for adjacent pixels, DFC noise is determined to be present in the candidate pixel and the data value of the candidate pixel is changed with a DFC noise-free pixel value (S16). The predetermined value may be one or more. Changing the data value of the candidate pixel with the DFC noise-free pixel value may be performed, for example, by selecting the data value of the candidate pixel from a lookup table (e.g., a third lookup table in which DFC free values are predefined) and performing dithering (Dither2) in order to compensate for displacement in a pixel data value that may occur during the above process.

After S16, a determination is made as to whether the candidate pixel is a last pixel in the set region or the image (S17). When the candidate pixel is not the last pixel in the set area or the image, operations S12 and S13 are repeated with respect to a subsequent candidate pixel.

Figure 4:
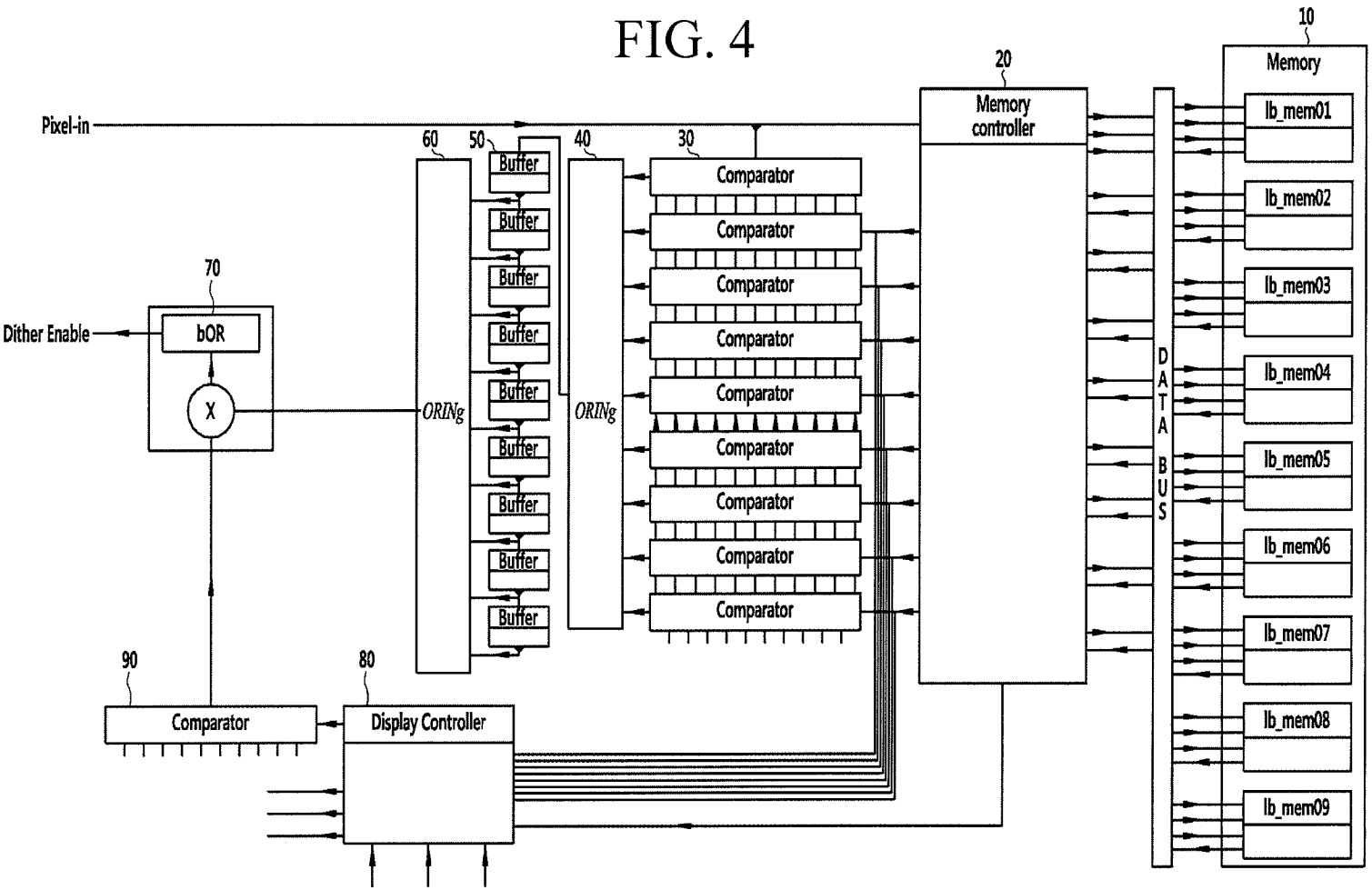
FIG. 4 illustrates an apparatus to perform DFC pixel detection.
Figure 5:
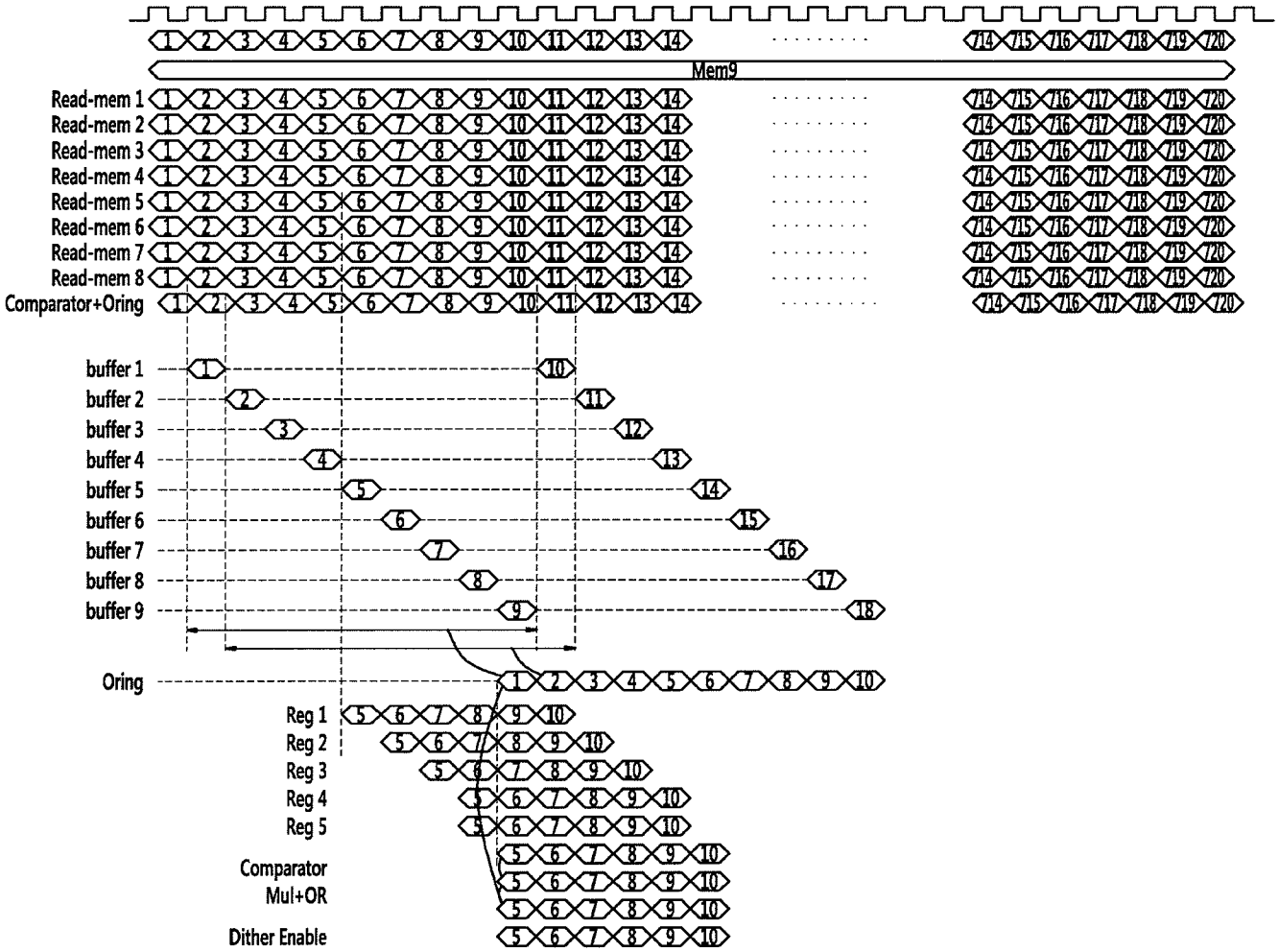
FIG. 5 illustrates a timing diagram for the DFC pixel detection apparatus.

FIG. 4 illustrates an embodiment of an apparatus for performing DFC pixel detection apparatus, and FIG. 5 illustrates an example of a timing diagram for the DFC pixel detection apparatus.

Referring to FIG. 4, the DFC pixel detection apparatus includes a memory controller 20, a number (e.g., nine) of line memories 10 connected in parallel to the memory controller 20, a number (e.g., nine) comparators 30 connected in parallel to the memory controller 20, a first logic (e.g., OR) operation element 40 connected to the comparators 30, a number (e.g., nine) buffer memories 50 connected in series to the first logic operation element 40 and to one another, and a second logic (e.g., OR) operation element 60 to which the buffer memories 50 are connected in parallel. The apparatus further includes a result integration module 70 connected to the second logic operation element 60, a comparator 90 connected to the result integration module 70, and a display controller 80 connected to the comparator 90 and memory controller 20.

The DFC pixel detection apparatus may be used for a variety of search regions between the maximum range and minimum range. When it is assumed that a 9×9 pixel region around a candidate pixel is selected as a search region, a DFC pixel may be detected through the following operations. (In this example, it is assumed that a DFC gray scale lookup table has 11 DFC candidate values. In other embodiments, the number of DFC candidate values in the DFC gray lookup table may be a different number, e.g., 10 or less or 12 or more.)

Initially, the nine line memories 10 receive, temporarily store, and buffer image data of nine pixel lines, respectively. Image data of tenth to eighteenth pixel lines are sequentially stored again in the first to ninth line memories 10. The above operation is repeated with respect to all pixel lines. (When a 7×7 pixel region is selected as the search region, only seven line memories 10 are used and image data of eighth to fourteenth pixel lines are sequentially stored again in the first to the seventh line memories 10. The number of line memories 10 may be eight or less, or may also be ten or more. Other size pixel regions may use a corresponding number of line memories and operations.)

The memory controller 20 receives and stores input pixel data and stores the input pixel data in the corresponding line memory 10 using, for example, a horizontal and vertical synchronization signal and a data enable signal. The memory controller 20 also reads corresponding data in parallel from the nine line memories 10. In one non-limiting example, line memory 10 may have a single port to read and write data.

When extracting a first pixel of the ninth pixel line, first pixels of preceding eight pixel lines are already extracted from eight line memories 10, respectively. When extracting an n-th pixel of the ninth pixel line, n-th pixels of preceding eight pixel lines are already extracted. (When a 7×7 pixel matrix region is selected as the search region, extraction of the seventh pixel of each seventh pixel line is completed and the same operation is repeated.)

The extracted nine sets of pixel data are individually compared to DFC candidate values stored in the lookup table LUT2 for adjacent pixels by the comparator 30. For example, the lookup table LUT2 for adjacent pixels may store 11 DFC candidate values.

Each of the nine sets of pixel data is compared with the lookup table LUT2 for adjacent pixels. Accordingly, each pixel has 11 bits of a comparison result word indicating the comparison result. Each bit of the comparison result word corresponds to a single DFC candidate value of the lookup table LUT2 for adjacent pixels. Nine comparison result words for the nine pixels are obtained. The number of comparators 30 may increase as the size of a lookup table increases. When a 7×7 pixel matrix is set as the search region, seven 11-bit comparison result words are obtained and all bits of the remaining two words become zeros.

The first OR operation element 40 generates an accumulated 11-bit word by performing a bit-by-bit parallel OR operation on the nine 11-bit comparison result words. The 11-bit word provides an indication of whether any one of gray values of nine pixels matches any one of 11 DFC candidate values of the lookup table LUT2. When any one bit has a logical 1 value, a matching gray scale value may be determined to be found in at least one of the nine pixels.

The 11-bit word is stored in the first buffer memory 50. A process of storing a subsequent 11-bit word in the first buffer memory 50 and moving the 11-bit word stored in the first buffer memory 50 to the second buffer memory 50 is repeated.

When nine 11-bit words are received in the nine buffer memories 50, the second OR operation element 40 generates a final 11-bit word by performing a bit-by-bit OR operation on the buffer memory values. The final 11-bit word provides an indication of whether a gray scale value of any one pixel of the 9×9 pixel region matches any one of 11 DFC candidate values of the lookup table LUT2. When any one bit has a logical 1 value, a matching gray may be determined to be found in at least one pixel of the 9×9 pixel region. The number of buffer memories 50 may vary based on the number of line memories 10.

The comparator 90 generates an 11-bit word by comparing data of the candidate pixel with 11 DFC candidate values in the lookup table LUT1 for candidate pixels.

The result integration module 70 generates an integrated 11-bit word by performing a bit-by-bit multiplication operation on the final 11-bit word of the adjacent pixels and the 11-bit word of the candidate pixel. The result integration module 70 may then generate a single bit by performing an OR operation on respective bits of the integrated 11-bit word.

When a value of the single bit has a logical 1 value, DFC noise is determined to be present and dithering (Dither 2) is applied to the candidate pixel. When the value of the single bit has a logical 0 value, the DFC noise is determined to be absent and dithering (Dither 2) is not applied.

When MURA is absent, an attempt to remove DFC noise may involve optimum sub-field and a codeword selection. When MURA is present, an attempt to remove DFC noise may involve random data mapping (RDM) to remove MURA. This mapping attempts to distribute noise over the entire panel so that the noise becomes non-uniform.

One type of DFC noise is referred to as partial DFC noise. One method to remove partial DFC noise involves correcting data based on a level of DFC noise, by detecting potential DFC candidate pixels in real time. However, real-time detection of DFC candidate pixels may be difficult. In accordance with one or more of the aforementioned embodiments, DFC candidate pixels may be detected in real time and/or partial DFC noise maybe reduced or eliminated.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A method of detecting noise in an image, the method comprising:

(a) setting a region to be searched for dynamic false contour (DFC) noise, the region including a candidate pixel and at least one adjacent pixel;

(b) determining whether a data value of the candidate pixel matches a DFC candidate value of a first lookup table for candidate pixels, determining (b) including comparing the data value of the candidate pixel with the DFC candidate value of the lookup table for candidate pixels;

(c) detecting existence of DFC noise by determining whether a data value of the at least one adjacent pixel matches a DFC candidate value of a second lookup table for adjacent pixels, the determining including comparing the data value of the adjacent pixel with the DFC candidate value of the lookup table for adjacent pixels; and (d) changing the data value of the candidate pixel to a DFC noise-free pixel value when DFC noise is determined to be present in the candidate pixel.

2. The method as claimed in claim 1, wherein:

when the data value of the candidate pixel matches at least one DFC candidate value of the first lookup table for candidate pixels in (b), and the data value of the adjacent pixel matches at least one DFC candidate value of the second lookup table for adjacent pixels in (c), DFC noise is determined to be present in the candidate pixel.

3. The method as claimed in claim 2, wherein:

when the data value of the candidate pixel does not match the DFC candidate value of the first lookup table for candidate pixels in (b), (b) includes changing the candidate pixel to a subsequent pixel.

4. The method as claimed in claim 3, wherein:

when the data value of the candidate pixel matches at least one DFC candidate value of the first lookup table for candidate pixels in (b), and the data value of the adjacent pixel does not match the DFC candidate value of the second lookup table for adjacent pixels in (c), (b) includes changing the candidate pixel to the subsequent pixel.

5. The method as claimed in claim 1, wherein changing the data value of the candidate pixel to the DFC noise-free pixel value comprises:

selecting the data value of the candidate pixel from a third lookup table;

changing the selected data value of the candidate pixel to the DFC noise-free data value; and performing dithering to compensate for displacement in the data value of the candidate pixel.

6. A dynamic false contour (DFC) detection apparatus, comprising:

n line memories to receive and temporarily store image data of n pixel lines, respectively;

a memory controller to store input pixel data in the corresponding n line memories, and to extract corresponding pixel data from the n line memories in parallel;

n first comparators to compare the pixel data extracted by the memory controller with DFC candidate values stored in a lookup table for adjacent pixels, and to output a comparison result as an m-bit word;

first logic to generate accumulated m-bit words by performing a bit-by-bit parallel logic operation on the m-bit words output by the n first comparators;

n buffer memories to sequentially store the accumulated m-bit words generated by the first logic;

second logic to generate an m-bit word by performing a bit-by-bit logic operation on the accumulated m-bit words stored in one or more of the n buffer memories;

a second comparator to compare data of a candidate pixel with DFC candidate values stored in a lookup table for candidate pixels, and to output a comparison result as an m-bit word; and a result integration module to generate an integrated m-bit word by performing a bit-by-bit multiplication operation on the m-bit word generated by the second logic and the m-bit word output by the second comparator, and to detect existence of DFC noise based on the integrated m-bit word.

7. The apparatus as claimed in claim 6, wherein:

the result integration module generates a single bit by performing a logic operation on the respective bits of the integrated m-bit word.

8. The apparatus as claimed in claim 7, wherein:

when a value of the single bit has a first logical value, DFC noise is determined to be present in the candidate pixel, and when the value of the single bit has a second logical value, the DFC noise is determined to be absent in the candidate pixel.

9. The apparatus as claimed in claim 8, wherein:

when a k×k pixel region is set as a search region (where k denotes a natural number less than n), k line memories among the n line memories are used to temporarily store the image data.

10. The apparatus as claimed in claim 9, wherein:

when the k×k pixel region is set as the search region (where k denotes a natural number less than n), k first comparators among the n first comparators output the comparison result word of m bits and remaining first comparators output a word in which all the bits have the second logical value.

11. A method for detecting noise, the method comprising:

(a) determining whether a data value of a candidate pixel in a predetermined region of an image matches a first dynamic false contour (DFC) candidate value;

(b) determining whether a data value of at least one pixel adjacent to the candidate pixel matches a second DFC candidate value;

(c) detecting DFC noise based on (b); and (d) changing the data value of the candidate pixel based on (a) (b), and (c).

12. The method as claimed in claim 11, wherein (d) includes: changing the data value of the candidate pixel when the data value of the candidate pixel matches the first DFC candidate value and the data value of the at least one adjacent pixel matches the second DFC candidate value.

13. The method as claimed in claim 11, further comprising:

maintaining the data value of the candidate pixel when the data value of the candidate pixel does not match the first DFC candidate value or the data value of the at least one adjacent pixel does not match the second DFC candidate value.

14. The method as claimed in claim 11, wherein the predetermined region corresponds to less than all pixels of the image.

15. The method as claimed in claim 11, wherein the first DFC candidate value is included in a first lookup table.

16. The method as claimed in claim 15, wherein the second DFC candidate value is included in a second lookup table.

17. The method as claimed in claim 16, wherein the second lookup table is different from the first lookup table.

18. The method as claimed in claim 16, wherein (d) includes changing the data value of the candidate pixel to a value in a third lookup table.

19. The method as claimed in claim 18, wherein the third lookup table is different from at least one of the first lookup table or the second lookup table.

* * * * *